US006213188B1

(12) United States Patent
Huang

(10) Patent No.: US 6,213,188 B1
(45) Date of Patent: Apr. 10, 2001

(54) CORD CONTROL DEVICE FOR A VENETIAN BLIND TO CONTROL RAISING AND LOWERING OF THE SLATS

(76) Inventor: Tai-Long Huang, No. 382, Sec. 1, Yuan-Lu Rd., Fuhsing Hsiang, Changhua Hsien (TW)

( * ) Notice: Subject to any disclaimer, the term of this patent is extended or adjusted under 35 U.S.C. 154(b) by 0 days.

(21) Appl. No.: 09/507,248

(22) Filed: Feb. 18, 2000

(51) Int. Cl.[7] ..... E06B 9/324
(52) U.S. Cl. ..... 160/178.2 R
(58) Field of Search ..... 160/178.2 R, 168.1 R, 160/173 R, 172 R; 24/136 R, 115 L, 115 M

(56) References Cited

U.S. PATENT DOCUMENTS

| | | | | |
|---|---|---|---|---|
| 2,357,911 | * | 9/1944 | Schaefer | 160/178.2 R |
| 2,493,186 | * | 1/1950 | Delgaudio | 160/178.2 R |
| 2,594,637 | * | 4/1952 | Gertzon | 160/178.2 R |
| 3,952,789 | * | 4/1976 | Marotto | 160/178.2 R X |
| 4,180,118 | * | 12/1979 | Vecchiarelli | 160/178.2 R |
| 4,245,688 | * | 1/1981 | Vecchiarelli | 160/178.2 R |
| 4,327,797 | * | 5/1982 | Nakajima et al. | 160/178.2 R |
| 4,463,791 | * | 8/1984 | McClure | 160/178.2 R |
| 4,667,723 | * | 5/1987 | Spangenberg | 160/178.2 R |
| 4,945,970 | * | 8/1990 | Marocco | 160/178.2 R |
| 4,947,921 | * | 8/1990 | Chun-cheng | 160/178.2 R X |

* cited by examiner

*Primary Examiner*—David M. Purol
(74) *Attorney, Agent, or Firm*—Ladas & Parry

(57) ABSTRACT

A cord control device includes a mounting seat mounted removably in a horizontal top housing, from which a plurality of horizontal slats are suspended downwardly one above another. A bottom rail is disposed below the slats. Each of two control cords passes through the top housing and through the slats, and has a first end portion fastened to the bottom rail, and a second end portion which extends out of the top housing. An elongated rack is disposed in a roller-mounting space in the mounting seat. A pair of stationary rollers are journalled in the roller-mounting space one above the other proximate to the elongated rack and are passed slidably over by the second end portions of the control cords, respectively. A movable pinion is disposed movably in the roller-mounting space, and is passed slidably over by the second end portions of the control cords. The pinion is movable in the roller-mounting space to a first position, where the control cords can slide over the pinion to permit raising and lowering of the slats, and a second position, where the pinion is clamped between the rack and one of the stationary rollers so that the control cords are clamped between the pinion and one of the stationary rollers.

2 Claims, 6 Drawing Sheets

CORD CONTROL DEVICE FOR A VENETIAN BLIND TO CONTROL RAISING AND LOWERING OF THE SLATS

BACKGROUND OF THE INVENTION

The invention relates to a control device, more particularly to a cord control device for a Venetian blind to control raising and lowering of the slats.

DESCRIPTION OF THE RELATED ART

Referring to FIG. 1, a conventional Venetian blind includes an elongated housing 1, a horizontally disposed shaft 2 journalled in the housing 1, a plurality of slats 5 suspended one above another from the housing 1, a bottom rail 7 disposed below the slats 5, a pair of pulleys 3 provided on two end portions of the shaft 2, a cord control unit 8 provided at one end of the housing 1, and two pairs of tilting cords 4. Each of the tilting cords 4 is disposed at a longitudinal side of each of the slats 5, and has a top end secured to one of the pulleys 3 and a bottom end secured to the bottom rail 7 so that rotation of the shaft 2 can cause the tilting cords 4 to move up and down in order to tilt the slats 5. Each of the slats 5 has two end portions, each of which is formed with a through hole (5*a*). Each of two pull cords 6 has a first end passing through the vertically aligned through holes (5*a*) formed in the slats 5 and secured to the bottom rail 7, and a second end passing through the housing 1 and the cord control unit 8 and extending out of the housing 1.

Referring to FIG. 2, the cord control unit 8 is shown to include a stationary roller (8*a*) and a movable pinion (8*b*). The pull cords 6 pass between the stationary roller (8*a*) and the movable pinion (8*b*), and are operable to move the movable pinion (8*b*) toward the stationary roller (8*a*) so as to lock the pull cords 6 and so as to position the slats 5, or away from the stationary roller (8*a*) so as to release the pull cords 6 and to permit raising or lowering of the slats 5.

The aforesaid conventional Venetian blind achieves the purposes of raising and lowering the slats 5. However, the cord control unit 8 has to be mounted at one end of the top housing 1, thereby restricting the moving space of the pull cords 6 with respect to the side wall adjacent to said end of the top housing 1 and resulting in inconvenience when operating the pull cords 6.

Furthermore, in case the horizontal length of the top housing 1 in the conventional Venetian blind is over sized and does not correspond to the size of a window to which the blind is applied, the top housing 1 has to be cut short. However, the top housing 1 cannot be cut short at two ends thereof in order to achieve the required length due to the presence of the cord control unit 8 at one of the ends thereof.

SUMMARY OF THE INVENTION

Therefore, the object of this invention is to provide a cord control device which is adapted be mounted in a Venetian blind and which is clear of the aforesaid disadvantages that result from the use of the conventional Venetian blind.

Accordingly, the cord control device of the present invention is used in a Venetian blind which includes an elongated horizontal top housing, a plurality of horizontal slats suspended downwardly from the top housing one above another, a bottom rail disposed below the slats, a pair of pulleys disposed spacedly in the top housing, and at least one first control cord and at least one second control cord. Each of the control cords passes through the top housing and through the slats, and has a first end portion fastened to the bottom rail, and a second end portion which extends out of the top housing. The cord control device includes a hollow mounting seat adapted to be mounted removably in the top housing between the pulleys, and having a bottom end, a top end, a roller-mounting space between the top and bottom ends, and an elongated rack disposed in the roller-mounting space. A pair of stationary rollers are journalled in the roller-mounting space one above the other proximate to the elongated rack. The first control cord is adapted to pass slidably over a lower one of the stationary rollers while the second control cord is adapted to pass slidably over and between the stationary rollers. A movable pinion is disposed movably in the roller-mounting space, and is adapted to be passed slidably over by the second end portions of the first and second control cords. The pinion is movable to a first position by virtue of swinging action of the first and second control cords in a first direction, where the control cords can slide over the pinion to permit raising and lowering of the slats, and a second position by virtue of swinging action of the first and second control cords in a second direction opposite to the first direction, where the pinion is clamped between the rack and one of the stationary rollers so that the control cords are adapted to be clamped between the pinion and the respective one of the stationary rollers, thereby preventing raising and lowering of the slats. A stop unit is provided to prevent removal of the pinion from the roller-mounting space in the mounting seat.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
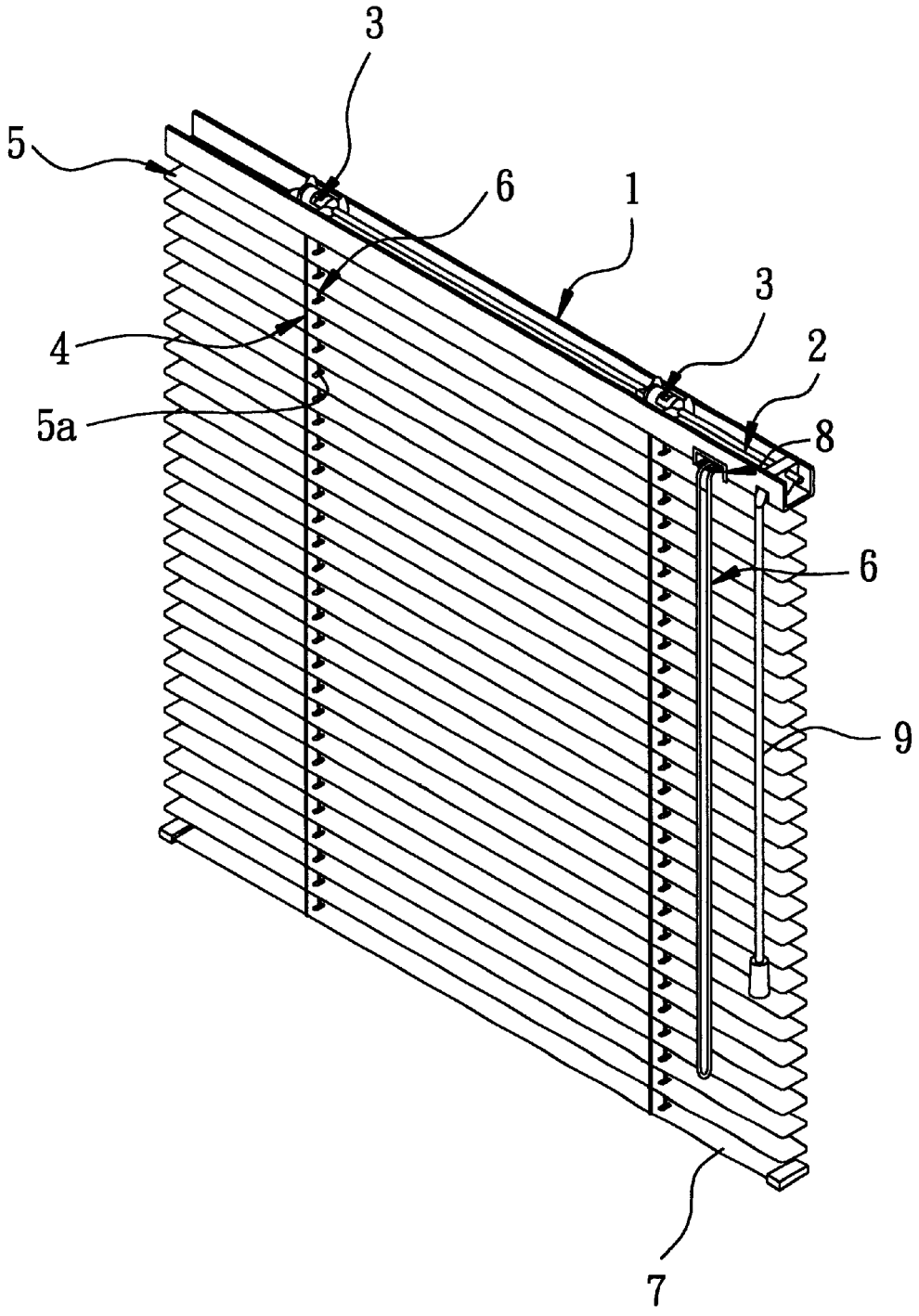
FIG. 1 PRIOR ART
FIG. 1 is a perspective view of a conventional Venetian blind provided with a cord control device for raising and lowering of the slats.
Figure 2:
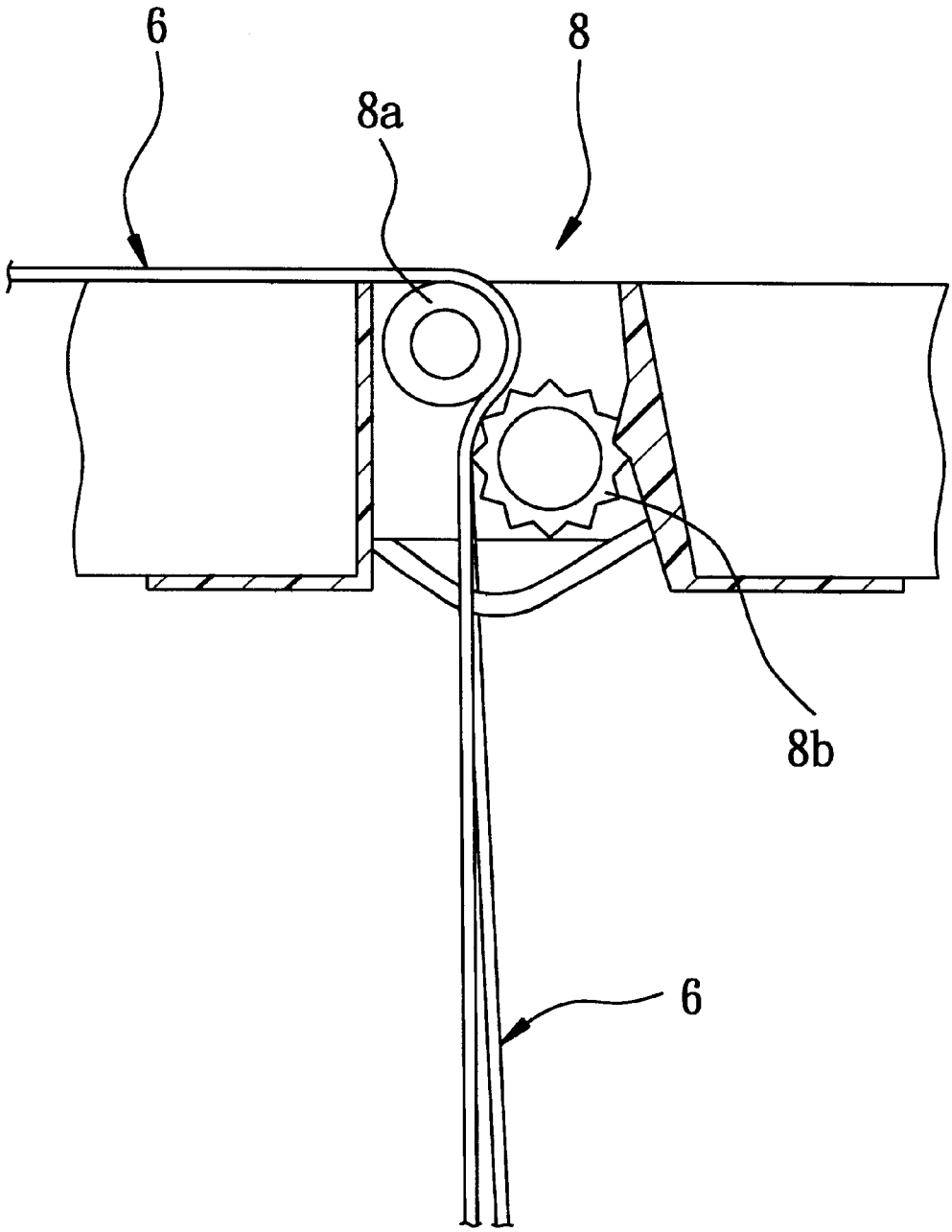
FIG. 2 PRIOR ART
FIG. 2 is a fragmentary sectional view of the conventional Venetian blind, illustrating how the cord control device is mounted therein.
Figure 3:
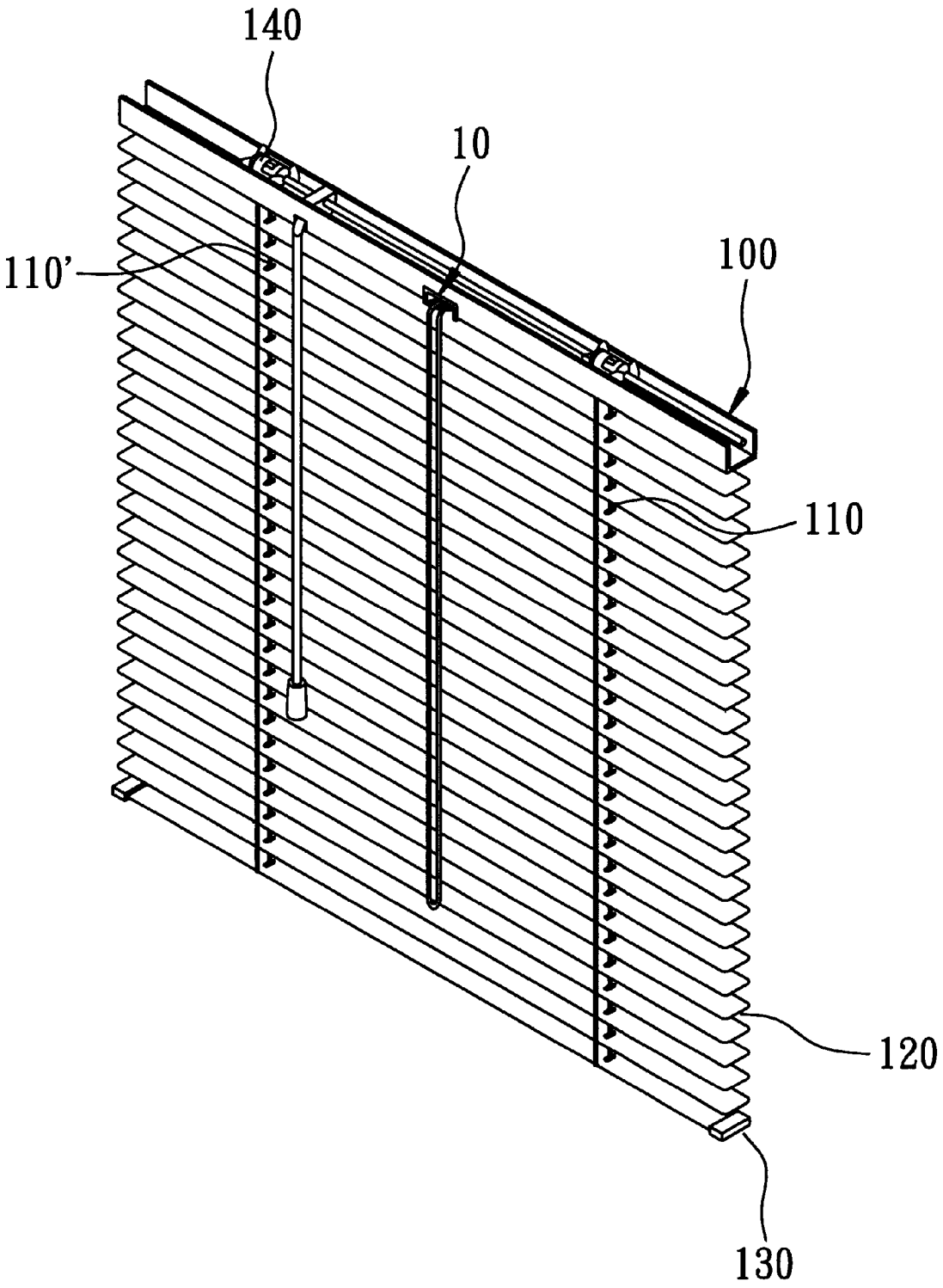
FIG. 3 a perspective view of a Venetian blind provided with the preferred embodiment of a cord control device of the present invention for raising and lowering of the slats.

The preferred embodiment of a cord control device 10 of the present invention is adapted to be mounted on a Venetian blind, as best shown in FIG. 3. The Venetian blind generally includes an elongated horizontal top housing 100, a plurality of horizontal slats 120 suspended from the top housing 100 one above another, a bottom rail 130 disposed below the slats 120, a pair of pulleys 140 disposed spacedly in the top housing 100, and first and second control cords 110',110. Each of the control cords 110',110 passes through the top housing 100 and through the slats 120, and has a first end portion fastened to the bottom rail 130, and a second end portion which extends out of the top housing 100 in a conventional manner.

Figure 4:
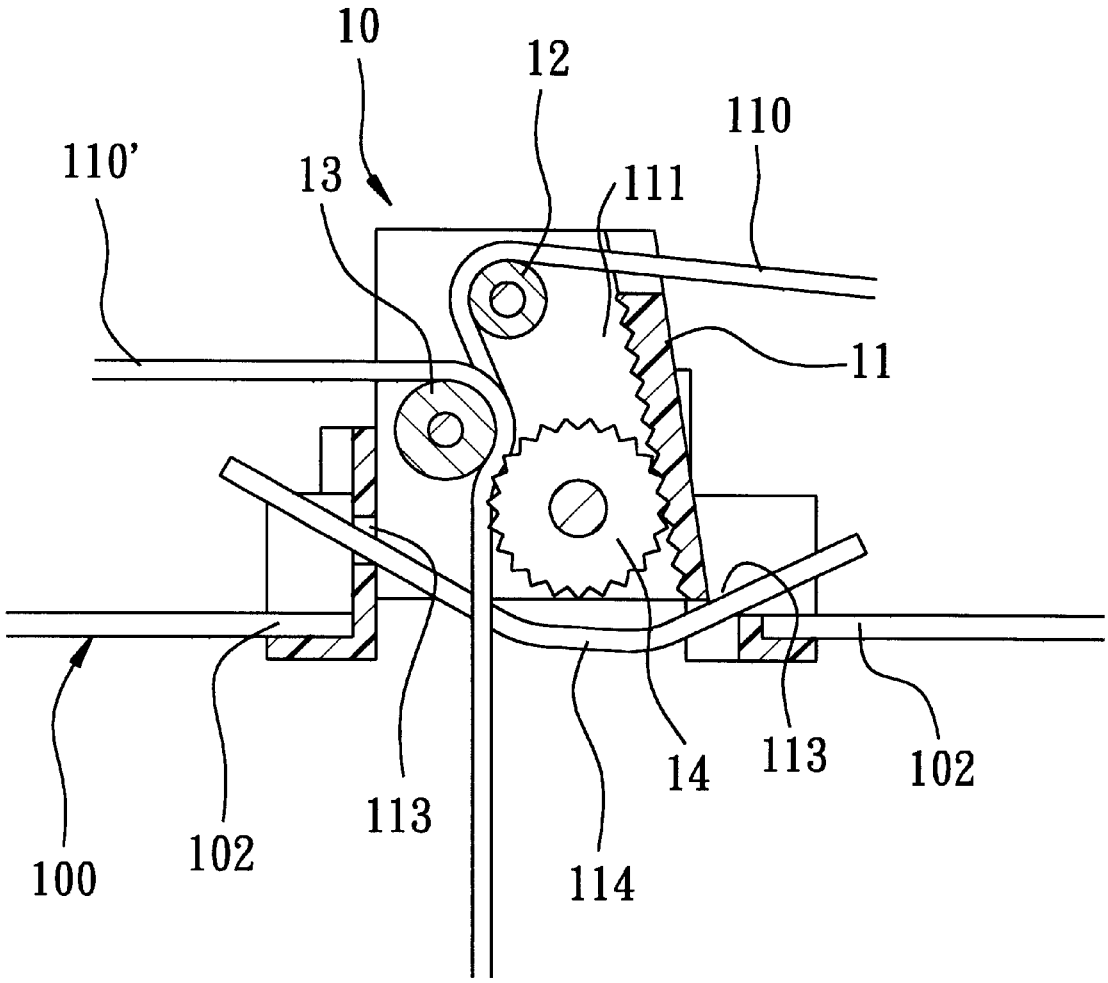
FIG. 4 is a fragmentary sectional view of the Venetian blind, illustrating how the preferred embodiment of the present invention is mounted therein.
Figure 5:
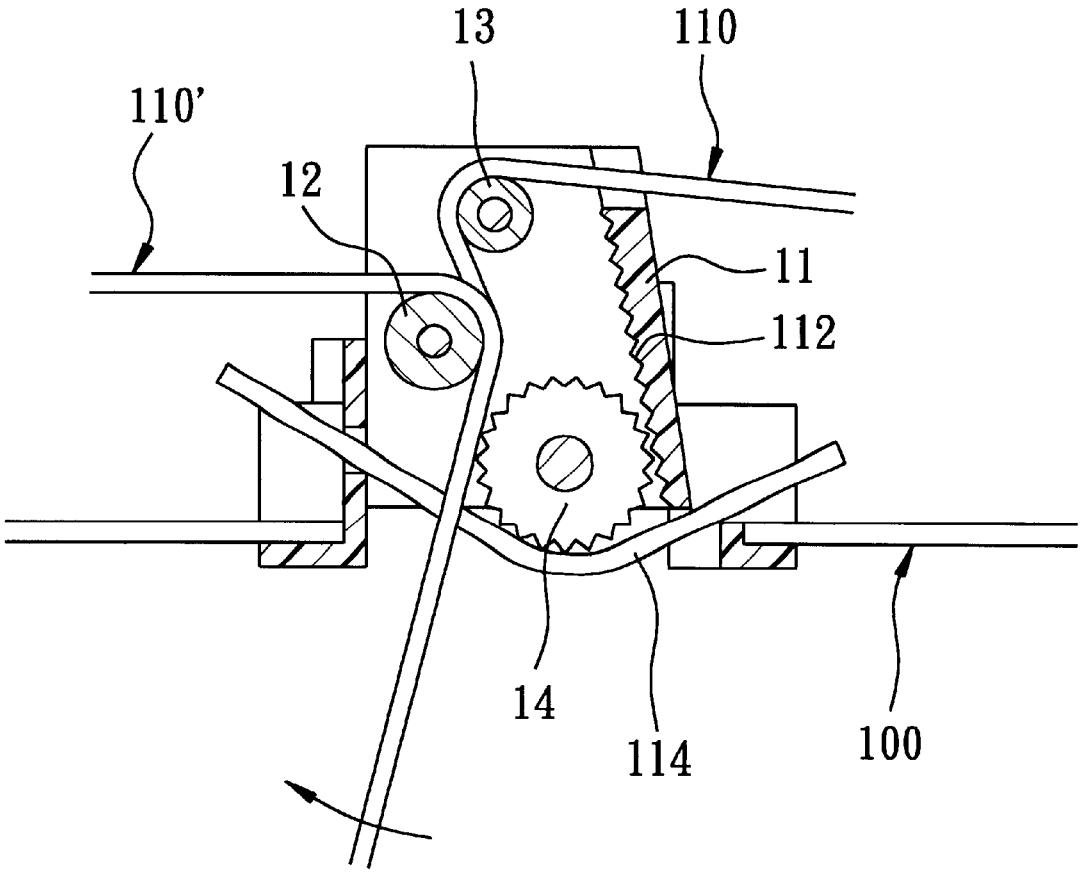
FIG. 5 is a fragmentary sectional view of the Venetian blind, illustrating how the preferred embodiment of the present invention is actuated in order to move the slats vertically.

Referring to FIGS. 4 and 5, the cord control device 10 of the present invention includes a hollow mounting seat 11 adapted to be mounted removably in the top housing 100 (see FIG. 3) between the pulleys 140, and having a bottom end, a top end, a roller-mounting space 111 between the top and bottom ends, and an elongated rack 112 disposed in the roller-mounting space 111. As to the mounting of the pulleys 140 in the top housing 100 is not pertinent to the present invention, a detailed description thereof is omitted herein for the sake of brevity.

A pair of stationary rollers 12, 13 are journalled in the roller-mounting space 111 in the seat 11 one above the other proximate to the elongated rack 112 such that the second end portion of the first control cord 110' is adapted to pass over a lower one of the stationary rollers 13,12, and such that the second end portion of the second control cord 110 is adapted to pass slidably over and between the stationary rollers 12, 13.

A movable pinion 14 is disposed movably in the roller-mounting space 111 of the seat 11, and is adapted to be passed slidably over by the second end portions of the first and second control cords 110', 110. The pinion 14 is movable to a first position by virtue of swinging action of the control cords 110', 110 in a first direction, as best shown in FIG. 5, where the control cords 110', 110 can slide over the pinion 14 to permit raising and lowering of the slats 130 (see FIG. 3), and a second position by virtue of swinging action of the control cords 110', 110 in a second direction opposite to the first direction, where the pinion 14 is clamped between the rack 112 and the lower one of the stationary rollers 12, 13 so that the first and second control cords 110',110 are adapted to be clamped between the pinion 14 and the respective stationary roller 13, thereby preventing raising and lowering of the slats 130.

A stop unit is provided to prevent removal of the pinion 14 from the roller-mounting space 111 of the mounting seat 11.

In the preferred embodiment, the mounting seat 11 is press-fitted in the top housing 100, and further has two mounting holes 113 that are formed therethrough adjacent to the bottom end of the seat 11 and that are located on two sides of the pinion 14. The stop unit includes an elongated rigid stop bar 114 disposed directly under the pinion 14, and has two opposite ends which extend through the mounting holes 113 in the mounting seat 11 and which extend to positions that are located directly over portions 102 of the top housing 100, in which the mounting seat 1 is press-fitted. Under such a condition, the pinion 14 is confined within a space that is located between the rack 112 and the control cords 110',110 and over the stop bar 114. The stop bar 114 prevents removal of the pinion 14 from the roller-mounting space 111.

Figure 6:
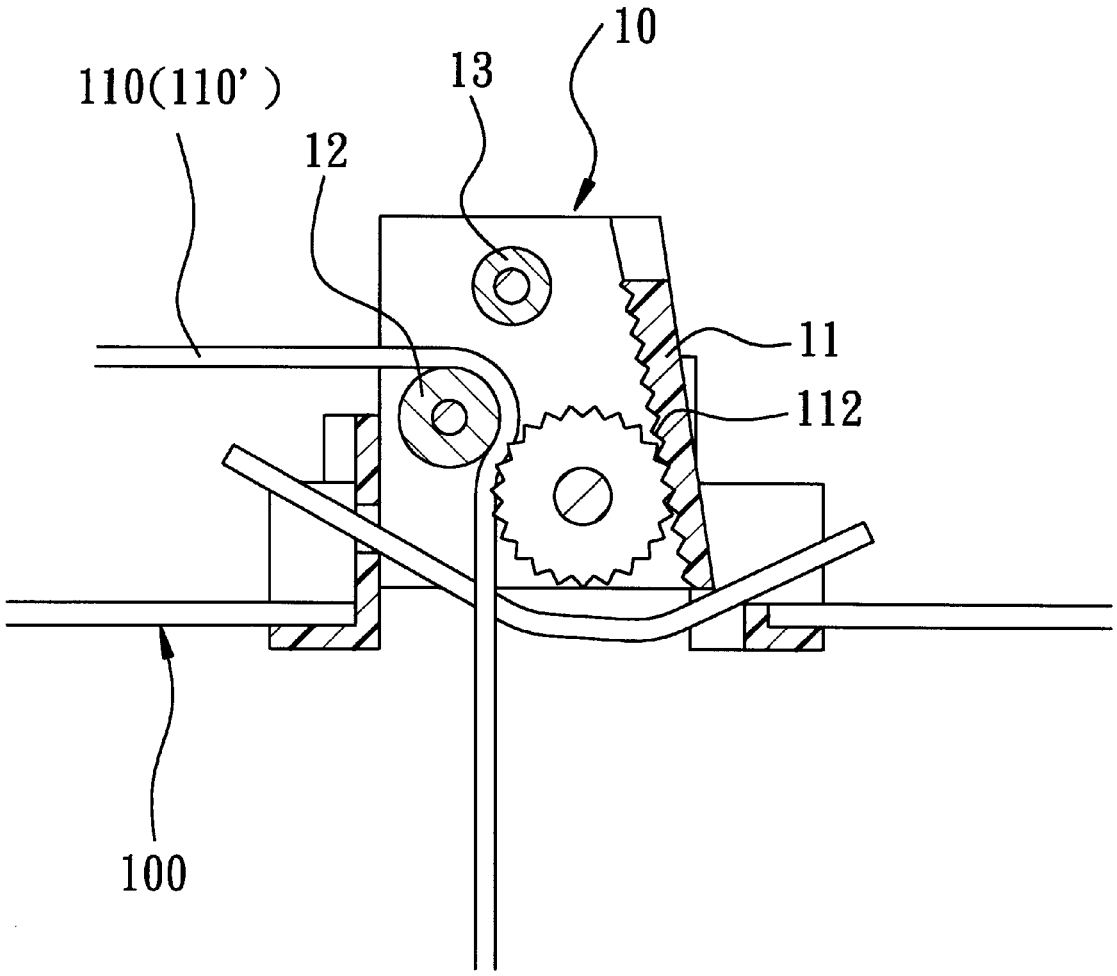
FIG. 6 is a fragmentary sectional view of the Venetian blind, illustrating how a modified cord control device of the present invention is mounted therein.

Referring to FIG. 6, a modified preferred embodiment is shown to be similar to that of the previous embodiment in structure, except that the mounting seat 11 is press-fitted at one end portion of the top housing 100. Under such a condition, the control cords 110', 110 are passed slidably over either one the stationary rollers 12, 13 prior to being passed slidably over the pinion 14.

Since the cord control device 10 of the present invention is disposed in the top housing 100 between two pulleys 140, in the case that the horizontal length of the top housing 100 is over sized and does not correspond to the size of a window to which the blind is applied, the top housing 100 can be shortened by cutting at two ends thereof in order to achieve the required length.

With this invention thus explained, it is apparent that numerous modifications and variations can be made without departing from the scope and spirit of this invention. It is therefore intended that this invention be limited only as indicated in the appended claims.

I claim:

1. A cord control device in a combination with a Venetian blind which includes an elongated horizontal top housing, a plurality of horizontal slats suspended downwardly from the top housing one above another, a bottom rail disposed below the slats, a pair of pulleys disposed spacedly in the top housing, and at least one first control cord and at least one second control cord, each of the control cords passing through the top housing and through the slats and having a first end portion fastened to the bottom rail, and a second end portion which extends out of the top housing, said cord control device comprising:

a hollow mounting seat mounted removably in the top housing between the pulleys, and having a bottom end, a top end, a roller-mounting space between said top and bottom ends, and an elongated rack disposed in said roller-mounting space;

a pair of stationary rollers journalled in said roller-mounting space one above the other proximate to said elongated rack, the first control cord passing slidably over a lower one of said stationary rollers, the second control cord passing slidably over and between said stationary rollers;

a movable pinion disposed movably in said roller-mounting space and passing slidably over by the second end portions of the first and second control cords, said pinion being movable to a first position by virtue of swinging action of the first and second control cords in a first direction, where the first and second control cords can slide over said pinion to permit raising and lowering of the slats, and a second position by virtue of swinging action of the first and second control cords in a second direction opposite to the first direction, where said pinion is clamped between said rack and the lower one of said stationary rollers so that the firs and second control cords are be clamped between said pinion and the lower stationary roller, thereby preventing raising and lowering of the slats; and a stop unit for preventing removal of said pinion from said roller-mounting space in said mounting seat.

2. The cord control device in combination with a Venetian blind as defined in claim 1, wherein said mounting seat is press-fitted in the top housing, and further has two mounting holes that are formed therethrough adjacent to said bottom end and that are located on two sides of said pinion, said stop unit including an elongated rigid stop bar disposed directly under said movable pinion and having two opposite ends which extend through said mounting holes in said mounting seat and which extend to positions that are located directly over portions of the top housing in which said mounting seat is press-fitted;

whereby, said pinion is confined within a space that is between said rack and the first and second control cords and over said top bar.

* * * * *